United States Patent [19]

Lehman

[11] 4,318,739

[45] Mar. 9, 1982

[54] STEEL HAVING IMPROVED SURFACE AND REDUCTION OF AREA TRANSVERSE PROPERTIES, AND METHOD OF MANUFACTURE THEREOF

[75] Inventor: Albert L. Lehman, Glenview, Ill.

[73] Assignee: A. Finkl & Sons Co., Chicago, Ill.

[21] Appl. No.: 45,684

[22] Filed: Jun. 5, 1979

[51] Int. Cl.[3] ..... C22C 38/06

[52] U.S. Cl. ..... 75/124; 148/36

[58] Field of Search ..... 75/124 B, 124 EB; 148/36

[56] References Cited

U.S. PATENT DOCUMENTS

| | | | |
|---|---|---|---|
| 2,861,908 | 11/1958 | Mickelson et al. | 148/31 |
| 2,919,188 | 12/1959 | Furgason | 75/128 |
| 2,921,849 | 1/1960 | Furgason | 75/128 |
| 2,959,506 | 11/1960 | Carman | 148/36 |
| 3,110,586 | 11/1963 | Gulya et al. | 75/128 |
| 3,316,084 | 4/1967 | Manganello | 75/128 |
| 3,328,211 | 6/1967 | Nakamura | 148/12 |
| 3,424,576 | 1/1969 | Fogleman et al. | 75/123 |
| 3,489,620 | 1/1970 | Current | 148/36 |
| 3,645,723 | 2/1972 | Riedel | 75/124 |
| 3,912,553 | 10/1975 | Waid | 75/124 |
| 3,994,754 | 11/1976 | Geymond | 148/36 |
| 4,026,727 | 5/1977 | Finkl et al. | 148/36 |
| 4,072,509 | 2/1978 | Zorev et al. | 75/124 |
| 4,157,258 | 6/1979 | Philip et al. | 75/124 |

FOREIGN PATENT DOCUMENTS

| | | | |
|---|---|---|---|
| 342941 | 7/1972 | U.S.S.R. | 148/36 |

*Primary Examiner*—M. J. Andrews

[57] ABSTRACT

A steel is disclosed having a broad composition range as follows:

| | |
|---|---|
| C | .50–.60 |
| Mn | .75–.95 |
| S | Usual |
| P | Usual |
| Si | .15–.35 |
| Cr | .85–1.15 |
| Ni | .60–2.00 |
| Mo | .25–.55 |
| V | .0–.30 |
| Al | .015–.30 |
| Ti | .003–.0075 |

Balance—Substantially all Fe with the usual impurities.

6 Claims, No Drawings

STEEL HAVING IMPROVED SURFACE AND REDUCTION OF AREA TRANSVERSE PROPERTIES, AND METHOD OF MANUFACTURE THEREOF

This invention relates generally to a steel composition in which ingot panel cracking, that is, poor surface conditions, are eliminated or very greatly reduced, and ductility, as defined in terms of reduction of area transverse is increased up to absolute values of 30 percent, and, in terms of the ratio of reduction of area transverse to reduction of area longitudinal, approaches 1.0, and a method of producing said steel composition.

Since the above described characteristics with which this invention is concerned are critical to die steels used in the closed die forging industry, the invention will be described by reference to low alloy (i.e.: less then 10 percent non-ferrous alloy constituents) die steels intended for use in the closed die forging industry, such as die blocks, sow blocks, tie plates, bolster plates, die holder plates and die inserts, and parts which are subjected to similar, rugged working conditions and stresses, such as gears and shafts. Most frequently reference will be made to a closed forging die which is subjected to possibly the most rugged operating conditions in industry in terms of impact, heating and cooling, and corrosion susceptible operating conditions.

BACKGROUND OF THE INVENTION

Steels of the general compositions set out in U.S. Pat. Nos. 1,464,174 and 2,331,900 have been developed to a high degree of proficiency, and today such steels have acquired a reputation in the closed die forging industry for quality and durability; indeed, one, which is sold under the trademark FX, has long been recognized as a leading steel in this industry.

However, from the producers point of view there is still room for improvement because the problem of ingot panel cracking is occasionally encountered, and, from the users point of view, increased die life is always desirable.

Panel cracking is a condition which has long plagued the alloy steel maker. Panel cracks generally occur near the base of the ingot and extend in depth up to or beyond the mid-radial portion of an ingot. In ingots of up to about 9 inches thickness, panel cracking is quite rare, but the frequency of occurence increases with increasing ingot size over about nine inches. The cracks may be quite deep, and, when discovered, normal processing must be interrupted and the cracks ground or torched off, if possible, before processing can resume. Such rectification steps obviously increase the cost of production to a producer, if indeed the crack is sufficiently minor that the ingot can be salvaged for further processing.

It is well documented that the occurrence of panel cracking increases with greater frequency and severity in steels containing aluminum, and, further, that steels containing aluminum and nitrogen are particularly susceptible, with the severity of cracking increasing with an increase in nitrogen. For a fuller discussion of the problem, and general background information, reference is made to the Journal of the Iron and Steel Institute, March, 1959, pages 250–256. A further literature reference which speaks in terms of catastrophic deterioration in hot workability when aluminum nitride is present in steels at forging temperature is found in the Journal of the Iron and Steel Institute, January, 1964, pages 32–41.

As is well-known, aluminum is an essential element in closed die forging steels for a number of reasons, including its deoxidizing capability and its ability to ensure the attainment of fine grain size which is essential to long die life. However, as is well known to those skilled in the art, too much aluminum tends to coarsen grain size. Nitrogen is also inherently present in closed die forging steels due to the balance which must be struck between cost and quality in the steel making process.

Hence, the production of the type of steels here under discussion, and particularly the producer of closed die forging steels, must cope with the adverse characteristics of aluminum and nitrogen.

A highly desirable property in any of the type of steels under discussion, including closed die forging steels, is high durability, as measured by reduction of area transverse, in connection with all the other characteristics of such steels, including high strength, high hardness and wear resistance, and high corrosion and fatique resistence. Since such steels are forged, it is well known, up to now, that the reduction of area will always be greater in the longitudinal direction as contrasted to the transverse direction of the direction of forging. It is also well recognized that the ideal closed die forging steel should have the same high reduction of area in both a transverse and longitudinal direction so that the steel, when made into a die, will be equally resistant to cracking in all directions. Attainment of this goal would also greatly simplify die design, since the die designer can ignore the "grain" of the steel in designing and fabricating the die, and greater die life should be achievable.

Accordingly, a primary object of the invention is to provide a low alloy steel composition having a medium carbon content which is capable of use as a forging die in closed die forging and in which surface problems, such as panel cracking, in the manufacturing process have been eliminated, or the frequency thereof very greatly reduced as contrasted to the frequency of panel cracking currently encountered by the steelmaker.

Another object of the invention is to provide a low alloy steel composition having a medium carbon content which is capable of use as a forging die in closed die forging, and in which the reduction of area transverse is in the range of from about 15 percent to about 30 percent.

Yet a further object of the invention is to provide a low alloy steel composition having a medium carbon content in which the ratio of the reduction of area transverse to the reduction of area longitudinal closely approaches 1.0.

Yet a further object of the invention is to provide an efficient, reproducible, and economical method of producing steel having the properties described above.

Other objects and advantages of the invention will be apparent from the following description of the invention.

SUMMARY OF THE INVENTION

The steel composition of this invention includes, in a medium carbon steel having from about 0.50 to about 0.60 percent by weight of carbon and significant nickel, chromium, molybdenum, vanadium, and aluminum constituents, a small but effective quantity of titanium and, a method of producing such steel which includes the feature of adding titanium to the molten steel at a point in the processing cycle in which oxygen content of the molten steel is at a low point whereby relatively harmless titanium carbo nitride is produced instead of aluminum nitride which is recognized as being deleterious to the attainment of the above described properties.

DETAILED DESCRIPTION OF THE INVENTION

The broad, intermediate, and preferred compositional ranges of the new and improved steel are as follows:

| Elements | Broad | Intermediate | Preferred |
|---|---|---|---|
| C | .50–.60 | .52–.58 | .53–.56 |
| Mn | .75–.95 | .75–.95 | .75–.95 |
| S | Usual | Usual | Usual |
| P | Usual | Usual | Usual |
| Si | .15–.35 | .15–.35 | .15–.35 |
| Cr | .85–.1.15 | .85–1.15 | .85–1.15 |
| Ni | .60–2.00 | .90–1.50 | .90–1.50 |
| Mo | .25–.55 | .35–.50 | .35–.50 |
| V | .0–.30 | .03–.07 | .03–.07 |
| Al | .015–.030 | .015–.020 | .015–.020 |
| Ti | .003–.0075 | .005–.020 | .005–.020 |
| Balance | substantially all iron with the usual impurities. | | |

Carbon is essential in order to provide the necessary strength and hardness for the hot working environments in which the steel will be employed. If the carbon content is much above 0.60, the steel becomes difficult to weld, and it is highly desirable that the steel be weldable so that cracks and repairs due to accidents or mishandling in the field can be easily made. If the carbon count is much below about 0.50, it is difficult to achieve the required hardness. Thus the broad range of carbon in the steel is from about 0.50 to about 0.60, and, more preferably in the range of about 0.52 to about 0.58, and, most preferably in the range of about 0.53 to 0.56.

Manganese is necessary in order to reduce red shortness caused by sulfur. As is well known in the art, manganese readily combines with sulfur and, as a general rule, it is desirable to add manganese at a rate of at least 20 times the sulfur content. From long experience a range of from about 0.75 to 0.95 has proven to be quite satisfactory, the upper end of the range avoiding the well known problems associated with excess manganese in a medium carbon steel.

Phosphorus is a tramp element in the steel, and should be kept as low as economically feasible. Amounts up to about 0.025 are tolerable.

Sulfur is a desirable element in that it promotes machineability. Accordingly, sulfur contents of up to as much as 0.040 are acceptable.

Silicon is important because of its contribution to the steelmaking process including, particularly, serving as a blocking agent, and its contribution to cleanliness and deoxidation in the steelmaking process. Again long experience has shown that silicon in the range of from about 0.15 to 0.35 is acceptable.

Chromium contributes to secondary harding and temper resistence, toughness and hardenability. Steels of the type here involved containing chromium are characterized by a low carbon martensitic structure when air cooled, whereas similar steels which lack chromium are characterized by the less desirable low carbon bainite structure. Substantially greater amounts of chromium have an adverse effect on toughness, and accordingly it is preferred that chromium be present in the range of about from about 0.85 to about 1.15.

Nickel is essential because of its contribution to toughness, in particular, and hardenability. It also helps heat checking. If substantially more nickel is present then specified, the die may be flake sensitive and tend to retain austenite. Further, nickel is a relatively expensive element. If substantially less nickel is present then that specified requisite toughness may not be achieved. Accordingly it is preferred that nickel be present in the range of from about 0.60 to 2.00, and more preferably in the range of about 0.90 to 1.50, based on long experience with this general type of steel.

Molybdenum is essential because of its contribution to carbide formation and hence hardness throughout a wide temperature range. It is important that a closed forging die or similar product not soften, wear, or erode in use, and molybdenum contributes to these desirable properties. Molybdenum also has a beneficial effect on hardenability. If more then the indicated amount of molybdenum is present, the carbon would have to be increased and a tendency toward brittleness might develop. If less then the specified amount is present the desired effects may not be achieved. Accordingly, molybdenum should be present in the range of from about 0.25 to 0.55, and more preferably in the range of from about 0.35 to about 0.50.

Vanadium is essential because it provides increased temper resistence and secondary hardening since it is a potent carbide former. Vanadium also provides excellent hot hardness properties which translate into greater wear resistence in service as contrasted to similar steels which do not contain vanadium.

Vanadium is necessary in order to achieve the fine grain required by the demanding uses to which the steel of the present invention is subjected.

If high quantities of aluminum are used, it may be possible to eliminate vanadium altogether, although it is preferred that some vanadium be present, and that it be present in an amount up to about 0.30, and preferably, in the range of about 0.03 to about 0.07. If less then about 0.03 is employed (assuming the presence of a significant quantity of aluminum) the desired effect on grain size will not be obtained. Quantities over 0.30, or, in the intermediate range, over about 0.07 percent will not yield significantly improved results.

Aluminum is essential to ensure the attainment of a fine grain which is an essential characteristic of any forging die steel. If less than about 0.015 aluminum is present, the desired grain size effect will probably not be achieved. If more then about 0.030 aluminum is present, the tendency to grain coarsening may set in together with a tendency toward the generation of a greater quantity of non-metallic inclusions which affect surface notch toughness. In this invention, the aluminum is present from about 0.015 to about 0.02 percent.

Calcium is an optional element and, if present, may be present in an amount up to about 0.02.

The contribution of titanium can best be appreciated by a reference to the role of inclusions in steel, and the contribution thereto of aluminum and sulfur.

The so-called Type II inclusions, category A, are basically sulfides. These compositions when examined under a microscope show up as long string like objects. As mentioned, the sulfur is essential in order to provide machineability, but the "stringers" which are present as a result of the presence of sulfur have a very deleterious effect on reduction of area transverse.

This deleterious effect can be partially compensated by the addition of substantial quantities of aluminum, and the long string like objects made more rounded, or globular, Type III sulfide with a resultant increase in reduction of area transverse.

It is known that titanium will have a beneficial effect on the sulfide stringers, but it has been thought that quantities in excess of a very low amount, say about 0.005 to about 0.007, would immediately result in the formation of titanium sulfide and/or titanium oxide, which compounds are as deleterious, if not more so, to the desired properties as are the sulfides.

Note should also be made of the class B, C, and D categories of inclusions which are, respective, aluminates, silicates, and complex oxides. These latter three categories of inclusions can be as deleterious as the Type A sulfide category of inclusions.

It has been commented that the undesirable effects of the above inclusions can be controlled, that is, transformed to the globular shape, not eliminated from the steel by careful contrl of the steelmaking process and the addition of the specified amounts of titanium.

Specifically, it is thought that by adding titanium to the steel making process at a point in the processing cycle in which oxygen is at a low level, the tendency to form the deleterious substances TiO and TiS is eliminated, and titanium carbo nitride is formed in preference to aluminum nitrides.

Further, although sufficient scientific substantiation is yet lacking, it is believed that aluminum nitrides are held in the grain boundaries thereby causing a weakness of the steel, whereas titanium carbo nitride formations are held within the grains, and enhance the strength of the steel. The aluminum nitrides in the grain boundaries weaken the surface of the ingot and result in panel cracking during forging. The titanium combines actively with the nitrogen to form titanium nitrides which penetrate the grains, thereby eliminating a potential point of cleavage, that is, to say, stress risers, in the grain boundaries.

The beneficial results obtained by the addition of titanium, and the balancing of the titanium and aluminum contents, can be seen from the following specific examples.

Three groups of heats of steel of the basic composition set out in the Broad, Intermediate, and Preferred range table above were melted.

The first group of four heats did not contain titanium and were melted to the best published steel processing procedures.

The second group of five heats did not contain titanium, but were processed according to a procedure in which special care was taken to keep the oxygen level as low as possible throughout the cycle.

The third group of four heats contained titanium in the range of from about 0.0030 to 0.0075, and were processed according to the procedure set out in the second group of heats.

Samples from all heats, after identical post-melting treatment consisting of a single quench and temper from about 1130° F., were tested for reduction of area with the following results:

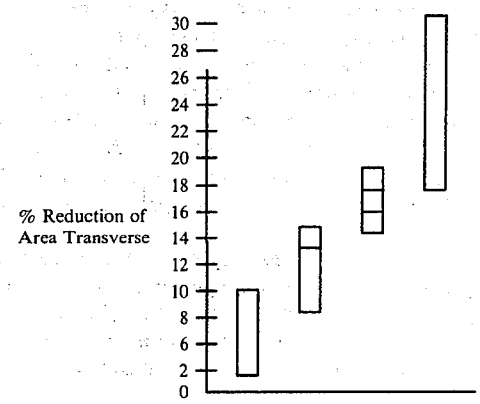

| Group 1 | Group 2 | Group 3 |
|---|---|---|
| (2.2–9.8) | (8.2–15.9) | (15.6–19.5) |

All samples at mid-radius, approximately 10×12×14 blocks.

A typical composition of the group 3 steels was: C—56, Mn—0.85, P—0.018, S—0.31, Ni—0.91, Cr—1.03, Mo—0.34, V—0.043, Al—0.016, and Ti—0.003.

The step-by-step improvement is obvious, with the oxygen control used in processing the group 2 steels showing a 100 percent improvement over the group 1 steels, and the titanium addition employed in the group 3 steels showing a further 56 percent improvement over the group 2 steels.

In another test, performed on a steel processed in accordance with the group 3 procedure, the following results were obtained:

CHEMICAL ANALYSIS-WEIGHT PERCENT

| C | Mn | P | S | Si | Ni | Cr | Mo | V | Cu | Sn | Al | Ti |
|---|---|---|---|---|---|---|---|---|---|---|---|---|
| .57 | .81 | .017 | 0.22 | .26 | .98 | .94 | .36 | .05 | .13 | .008 | .028 | .0075 |

TENSILE AND IMPACT TESTING

| Q&T | Tensile PSI | Yield, PSI | Elongation, % | Red. of Area % | Impact, Ft-LB |
|---|---|---|---|---|---|
| | Long (12" Direction) Transverse | | | | |
| (1130° F.) | 163,000 | 153,000 | 12.0 | 28.8 | 17.3 |
| | Short (10" Direction) Transverse | | | | |
| (1130° F.) | 161,500 | 150,000 | 12.5 | 28.2 | 21.0 |

Field results in which steels of the group 3 type were compared with steels of the group 2 type disclosed the following in production of single size of crankshaft, which, as those skilled in the art can appreciate, is one of the most difficult products for application of a closed die forging steel.

Basic Die Block Size—12½"×22×40

Die 1—15% greater die life

Die 2—5% greater die life

Ave.—10% greater die life

Although the processing cycle for the group 3 steels can be appreciated by one skilled in the art, the following self-explanatory description is included:

A 70 ton heat of basic electric furnace steel was tapped at 2990 degree F. and an oxygen content of 80 ppm and a hydrogen content of 4–5 ppm.

Thereafter nickel, molybdenum, vanadium, silicon, manganese, chromium and iron pyrites were added to the ladle, together with conventional complex oxides for inclusion shape control, such as CaSi. Following ladle additions temperature was determined to be 2900 degrees F., the oxygen content 50 ppm, and the hydrogen 4–5 ppm.

Thereafter the heat was subjected to a vacuum arc heating processing for about eight minutes which process is described in U.S. Pat. No. 3,501,289 and elsewhere in the literature. Temperature at the conclusion of the vacuum arc degassing process was approximately 2890 degrees F.

The vacuum arc degassing processing was followed by a vacuum degassing process of approximately eighteen minutes, at the conclusion of which the following readings were taken: Oxygen—28 ppm, H2—1.55 ppm, N2—60 ppm.

Thereafter two separate conventional additions of aluminum and FeTi were made and purging gas was bubbled upwardly through the ladle of molten steel under atmospheric pressure conditions to ensure thorough mixing of the aluminum in the steel.

Following aluminum and Ti addition and mixing, the steel was teemed at a temperature 2850 degree F., plus or minus 10 degrees.

It will at once be apparent to those skilled in the art that modifications can be made without departing from the spirit and scope of the invention.

Accordingly, it is intended that the scope of the invention be limited solely by the scope of the pertinent prior art, and not by the foregoing exemplary description.

I claim:

1. A low alloy medium carbon forging steel consisting essentially of, by weight percent, and characteristics:

| Composition | |
|---|---|
| C | .50–.60 |
| Mn | .75–.95 |
| S | Usual |
| P | Usual |
| Si | .15–.35 |
| Cr | .85–1.15 |
| Ni | .60–2.00 |
| Mo | .25–.55 |
| V | .0–.30 |
| Al | .015–.30 |
| Ti | .003–.0075 |

Balance—Substantially all Fe with the usual impurities, together with the following characteristics:

(a) reduction of area transverse—15%–28%

(b) ratio of (i) reduction of area, transverse to (ii) reduction of area, longitudinal—up to 0.98.

2. The steel of claim 1 which has been single quenched and tempered from about 1130° F.

3. A low alloy medium carbon forging steel consisting essentially of, by weight percent, and characteristics:

| Composition | |
|---|---|
| C | .52–.58 |
| Mn | .75–.95 |
| S | Usual |
| P | Usual |
| Si | .15–.35 |
| Cr | .85–1.15 |
| Ni | .90–1.50 |
| Mo | .35–.50 |
| V | .03–.07 |
| Al | .015–.020 |
| Ti | .005–.020 |

Balance—Substantially all Fe with the usual impurities, together with the following characteristics:

(a) reduction of area transverse—15%–28%

(b) ration of (i) reduction of area, transverse to (ii) reduction of area, longitudinal—up to 0.98.

4. The steel of claim 3 which has been single quenched and tempered from about 1130° F.

5. A low alloy medium carbon forging steel consisting essentially of, by weight percent, and characteristics:

| Composition | |
|---|---|
| C | .53–.56 |
| Mn | .75–.95 |
| S | Usual |
| P | Usual |
| Si | .15–.35 |
| Cr | .85–1.15 |
| Ni | .90–1.50 |
| Mo | .35–.50 |
| V | .03–.07 |
| Al | .015–.020 |
| Ti | .005–.020 |

Balance—Substantially all iron with the usual impurities, together with the following characteristics:

(a) reduction of area transverse—15%–28%

(b) ration of (i) reduction of area, transverse to (ii) reduction of area, longitudinal—up to 0.98.

6. The steel of claim 5 which has been single quenched and tempered from about 1130° F.

* * * * *